US008302673B2

(12) United States Patent
Taras et al.

(10) Patent No.: US 8,302,673 B2
(45) Date of Patent: Nov. 6, 2012

(54) PARALLEL FLOW EVAPORATOR WITH SPIRAL INLET MANIFOLD

(75) Inventors: Michael F. Taras, Fayetteville, NY (US); Allen C. Kirkwood, Brownsburg, IN (US); Robert A. Chopko, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 12/868,448

(22) Filed: Aug. 25, 2010

(65) Prior Publication Data

US 2011/0042049 A1 Feb. 24, 2011

Related U.S. Application Data

(62) Division of application No. 10/986,680, filed on Nov. 12, 2004, now Pat. No. 7,806,171.

(51) Int. Cl.
*F28F 9/02* (2006.01)
*F28F 13/08* (2006.01)

(52) U.S. Cl. ..... 165/174; 165/147

(58) Field of Classification Search ..... 165/172, 165/173, 174, 175, 176, 153
See application file for complete search history.

(56) References Cited

U.S. PATENT DOCUMENTS

| | | | | |
|---|---|---|---|---|
| 2,097,602 | A | 11/1937 | Rohlin | |
| 3,223,155 | A * | 12/1965 | Hubbard | 165/176 |
| 3,976,128 | A | 8/1976 | Patel et al. | |
| 4,261,177 | A | 4/1981 | Sterlini | |
| 4,277,953 | A | 7/1981 | Kramer | |
| 4,309,987 | A | 1/1982 | Higgins, Jr. | |
| 4,382,468 | A | 5/1983 | Hastwell | |
| 4,524,823 | A | 6/1985 | Hummel et al. | |
| 4,593,539 | A | 6/1986 | Humpolik et al. | |
| 5,103,559 | A | 4/1992 | Hoffmuller | |
| 5,343,620 | A | 9/1994 | Velluet | |
| 5,523,607 | A | 6/1996 | Zambrano | |
| 5,651,268 | A | 7/1997 | Aikawa et al. | |
| 5,704,221 | A | 1/1998 | Lego | |
| 5,743,111 | A | 4/1998 | Sasaki et al. | |
| 5,765,393 | A | 6/1998 | Shlak et al. | |
| 5,806,586 | A * | 9/1998 | Osthues et al. | 165/174 |
| 5,881,456 | A | 3/1999 | Bergins et al. | |
| 5,901,785 | A | 5/1999 | Chiba et al. | |
| 5,931,220 | A | 8/1999 | Ueda et al. | |
| 5,941,303 | A | 8/1999 | Gowan et al. | |
| 6,053,243 | A | 4/2000 | Kato et al. | |
| 6,102,561 | A * | 8/2000 | King | 366/181.5 |
| 6,179,051 | B1 | 1/2001 | Ayub | |
| 6,286,590 | B1 | 9/2001 | Park | |
| 6,394,176 | B1 | 5/2002 | Marsais | |
| 6,430,945 | B1 | 8/2002 | Haussmann | |

(Continued)

FOREIGN PATENT DOCUMENTS

| | | | |
|---|---|---|---|
| GB | 2250336 | A | 6/1992 |

(Continued)

*Primary Examiner* — Tho V Duong
(74) *Attorney, Agent, or Firm* — Cantor Colburn LLP

(57) ABSTRACT

In a parallel flow heat exchanger having an inlet manifold connected to an outlet manifold by a plurality of parallel channels, a spirally shaped insert is disposed within the refrigerant flow path in the inlet manifold such that a swirling motion is imparted to the refrigerant flow in the manifold so as to cause a more uniform distribution of refrigerant to the individual channels. Various embodiments of the spirally shaped inserts are provided, including inserts designed for the internal flow of refrigerant therethrough and/or the external flow of refrigerant thereover.

4 Claims, 3 Drawing Sheets

U.S. PATENT DOCUMENTS

| | | | |
|---|---|---|---|
| 6,470,703 | B2 | 10/2002 | Wada et al. |
| 6,484,797 | B2 | 11/2002 | Saito et al. |
| 6,679,434 | B2 | 1/2004 | Okumura et al. |
| 6,688,137 | B1 | 2/2004 | Gupte |
| 6,688,138 | B2 | 2/2004 | DiFlora |
| 6,729,386 | B1 | 5/2004 | Sather |
| 6,796,374 | B2 | 9/2004 | Rong |
| 6,814,136 | B2 | 11/2004 | Yi et al. |
| 6,988,539 | B2 | 1/2006 | Kato et al. |
| 7,021,371 | B2 | 4/2006 | Saito et al. |
| 7,143,605 | B2 | 12/2006 | Rohrer et al. |
| 2002/0174978 | A1 | 11/2002 | Beddome et al. |
| 2003/0010483 | A1 | 1/2003 | Ikezaki et al. |
| 2003/0116310 | A1 | 6/2003 | Wittmann et al. |

FOREIGN PATENT DOCUMENTS

| | | | | |
|---|---|---|---|---|
| JP | 03031665 | A | * | 2/1991 |
| JP | 03260567 | A | * | 11/1991 |
| JP | 4295599 | A | | 10/1992 |
| JP | 04371766 | | | 12/1992 |
| JP | 05203286 | | | 8/1993 |
| JP | 6159983 | | | 6/1994 |
| JP | 08086591 | | | 4/1996 |
| JP | 09310988 | A | * | 12/1997 |
| JP | 2001304775 | | | 10/2001 |
| WO | WO-9414021 | | | 6/1994 |

* cited by examiner

PARALLEL FLOW EVAPORATOR WITH SPIRAL INLET MANIFOLD

CROSS REFERENCE TO RELATED APPLICATION

This application is a divisional of prior U.S. patent application Ser. No. 10/986,680, filed Nov. 12, 2004, now copending, which is incorporated herein by reference.

BACKGROUND OF THE INVENTION

This invention relates generally to air conditioning and refrigeration systems and, more particularly, to parallel flow evaporators thereof.

A definition of a so-called parallel flow heat exchanger is widely used in the air conditioning and refrigeration industry now and designates a heat exchanger with a plurality of parallel passages, among which refrigerant is distributed and flown in an orientation generally substantially perpendicular to the refrigerant flow direction in the inlet and outlet manifolds. This definition is well adopted within the technical community and will be used throughout the specification.

Refrigerant maldistribution in refrigerant system evaporators is a well-known phenomenon. It causes significant evaporator and overall system performance degradation over a wide range of operating conditions. Maldistribution of refrigerant may occur due to differences in flow impedances within evaporator channels, non-uniform airflow distribution over external heat transfer surfaces, improper heat exchanger orientation or poor manifold and distribution system design. Maldistribution is particularly pronounced in parallel flow evaporators due to their specific design with respect to refrigerant routing to each refrigerant circuit. Attempts to eliminate or reduce the effects of this phenomenon on the performance of parallel flow evaporators have been made with little or no success. The primary reasons for such failures have generally been related to complexity and inefficiency of the proposed technique or prohibitively high cost of the solution.

In recent years, parallel flow heat exchangers, and brazed aluminum heat exchangers in particular, have received much attention and interest, not just in the automotive field but also in the heating, ventilation, air conditioning and refrigeration (HVAC&R) industry. The primary reasons for the employment of the parallel flow technology are related to its superior performance, high degree of compactness and enhanced resistance to corrosion. Parallel flow heat exchangers are now utilized in both condenser and evaporator applications for multiple products and system designs and configurations. The evaporator applications, although promising greater benefits and rewards, are more challenging and problematic. Refrigerant maldistribution is one of the primary concerns and obstacles for the implementation of this technology in the evaporator applications.

As known, refrigerant maldistribution in parallel flow heat exchangers occurs because of unequal pressure drop inside the channels and in the inlet and outlet manifolds, as well as poor manifold and distribution system design. In the manifolds, the difference in length of refrigerant paths, phase separation, gravity and turbulence are the primary factors responsible for maldistribution. Inside the heat exchanger channels, variations in the heat transfer rate, airflow distribution, manufacturing tolerances, and gravity are the dominant factors. Furthermore, the recent trend of the heat exchanger performance enhancement promoted miniaturization of its channels (so-called minichannels and microchannels), which in turn negatively impacted refrigerant distribution. Since it is extremely difficult to control all these factors, many of the previous attempts to manage refrigerant distribution, especially in parallel flow evaporators, have failed.

In the refrigerant systems utilizing parallel flow heat exchangers, the inlet and outlet manifolds or headers (these terms will be used interchangeably throughout the text) usually have a conventional cylindrical shape. When the two-phase flow enters the header, the vapor phase is usually separated from the liquid phase. Since both phases flow independently, refrigerant maldistribution tends to occur.

If the two-phase flow enters the inlet manifold at a relatively high velocity, the liquid phase (droplets of liquid) is carried by the momentum of the flow further away from the manifold entrance to the remote portion of the header. Hence, the channels closest to the manifold entrance receive predominantly the vapor phase and the channels remote from the manifold entrance receive mostly the liquid phase. If, on the other hand, the velocity of the two-phase flow entering the manifold is low, there is not enough momentum to carry the liquid phase along the header. As a result, the liquid phase enters the channels closest to the inlet and the vapor phase proceeds to the most remote ones. Also, the liquid and vapor phases in the inlet manifold can be separated by the gravity forces, causing similar maldistribution consequences. In either case, maldistribution phenomenon quickly surfaces and manifests itself in evaporator and overall system performance degradation.

SUMMARY OF THE INVENTION

Briefly, in accordance with one aspect of the invention, a structure is provided in association with the inlet manifold so as to create a swirling motion of the two-phase refrigerant flow in the evaporator inlet manifold to thereby obtain and uniformly distribute a homogenous two-phase mixture, that consist of liquid and vapor phases, among the parallel channels. At high velocities, the droplets of liquid are driven to the periphery of the manifold by the centrifugal force and some of them pass through the channels closest to the manifold entrance. In the case of low refrigerant velocities, the swirling motion creates the momentum that will carry some of the liquid droplets to the remote channels in the manifold. Additionally, mixing of the refrigerant vapor and liquid phases further promotes homogeneous flow conditions. In each case non-uniform refrigerant distribution is avoided.

In accordance with another aspect of the invention, the swirling motion is brought about by a spirally wound insert extending longitudinally within the inlet header and having a plurality of perforations for conducting the refrigerant flow into the internal cavity of the inlet header and then to the individual channels adjacent thereto.

In accordance with another aspect of the invention, the inlet manifold itself is formed in a spirally wound coil that extends along the entrance to the individual channels and is fluidly interconnected thereto by its individual elements.

By yet another aspect of the invention, a spirally formed, short insert is provided at the entrance to the inlet header and the refrigerant flow passing around the spiral insert prior to entering the inlet header.

By still another aspect of the invention, a spiral insert is placed within the inlet manifold preferably in a coaxial relationship therewith such that the outer surface of the spiral insert causes a desirable swirling of the refrigerant flow within the inlet manifold such that uniform distribution of refrigerant is provided to the individual channels.

In the drawings as hereinafter described, preferred and alternate embodiments are depicted; however, various other modifications and alternate constructions can be made thereto without departing from the true spirit and scope of the invention.

DESCRIPTION OF THE PREFERRED EMBODIMENT

Figure 1:
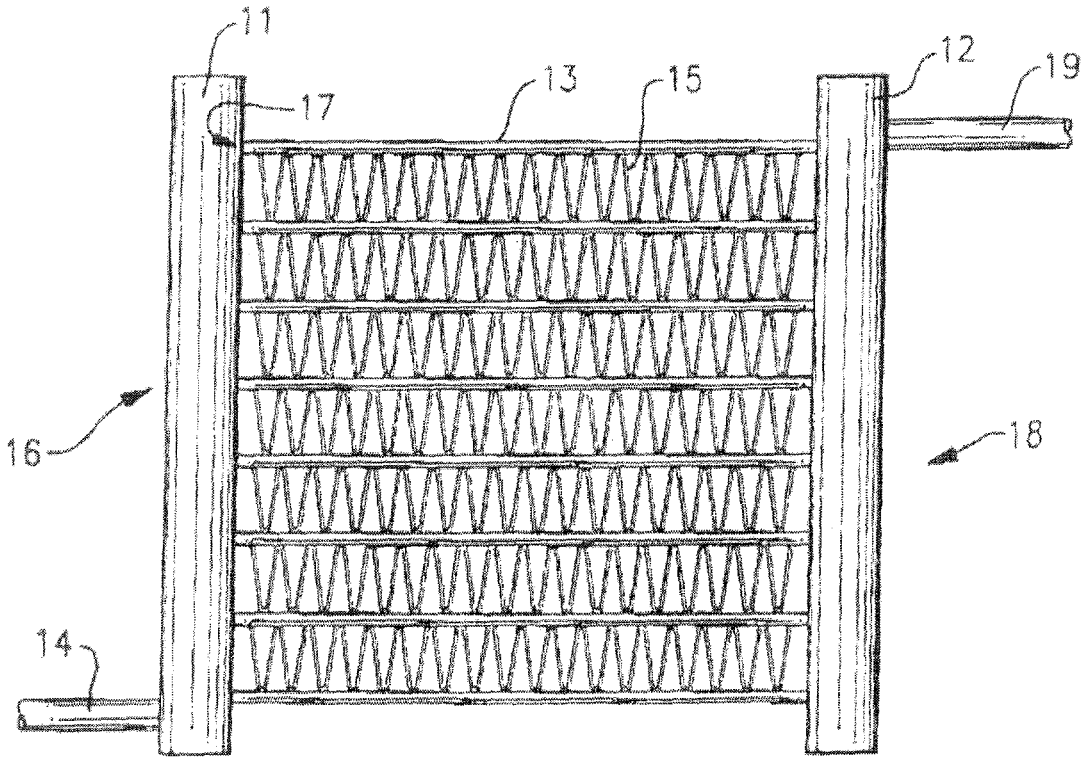
FIG. 1 Prior Art
FIG. 1 is a schematic illustration of a parallel flow heat exchanger in accordance with the prior art.

Referring now to FIG. 1, a parallel flow heat exchanger is shown to include an inlet header or manifold 11, an outlet header or manifold 12 and a plurality of parallel disposed channels 13 fluidly interconnecting the inlet manifold 11 to the outlet manifold 12. Generally, the inlet and outlet headers 11 and 12 are cylindrical in shape, and the channels 13 are tubes (or extrusions) of flattened or round shape. Channels 13 normally have a plurality of internal and external heat transfer enhancement elements, such as fins. For instance, external fins 15, disposed therebetween for the enhancement of the heat exchange process and structural rigidity are typically furnace-brazed. Channels 13 may have internal heat transfer enhancements and structural elements as well.

In operation, two-phase refrigerant flows into the inlet opening 14 and into the internal cavity 16 of the inlet header 11. From the internal cavity 16, the refrigerant, typically in the form of a mixture of liquid and vapor, enters the channels openings 17 to pass through the channels 13 to the internal cavity 18 of the outlet header 12. From there, the refrigerant, which is now usually in the form of a vapor, passes out the outlet opening 19 and then to the compressor (not shown).

As discussed hereinabove, it is desirable that the two-phase refrigerant passing from the inlet header 11 to the individual channels 13 do so in a uniform manner (or in other words, with equal vapor quality) such that the full heat exchange benefit of the individual channels can be obtained and flooding conditions are not created and observed at the compressor suction (this may damage the compressor). However, because of various phenomena as discussed hereinabove, a non-uniform flow of refrigerant to the individual channels 13 (so-called maldistribution) occurs. In order to address this problem, the applicants have introduced design features that will create a swirling motion of the two-phase refrigerant flow in the inlet manifold 11 to thereby bring about a more uniform flow to the channels 13. Also, the increased velocity typically associated with the swirling motion will further promote the mixing process of the liquid and vapor phases.

Figure 2A:
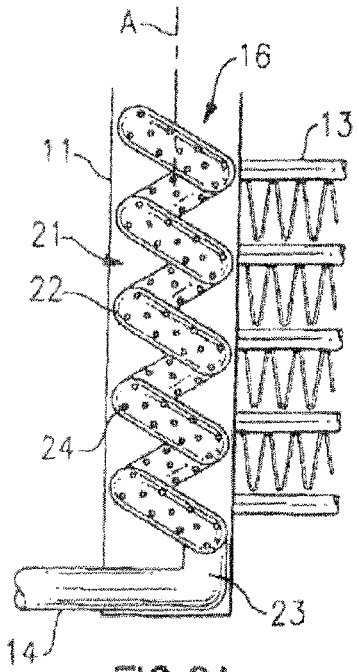
FIG. 2A is a schematic illustration of one embodiment of the present invention.

In the FIG. 2A embodiment, an insert 21 is located within the internal cavity 16 of the inlet manifold 11 as shown. The insert 21 is a tubular structure that is formed in a spiral coil with individual coil elements 22 as shown. The insert 21 is preferably suspended within the cavity by appropriate attachment, such as brazing or the like, at the side or end of the inlet manifold 11. Obviously, the support structure should not block or obstruct the entrance to the individual channels 13. As shown, the axis A of the spirally formed coil insert 21 is preferably coaxial with the axis of the inlet manifold 11.

The inlet opening 14 is fluidly connected by a tube 23 to one end of the insert 21 so as to cause the refrigerant to pass into the insert 21. A plurality of openings 24 in each of the coil elements 22 provides for fluid communication of the refrigerant from the internal portion of the insert 21 to the internal cavity 16 of the inlet manifold 11. The refrigerant exiting the openings 24 thus will have a swirling motion at increased velocity imparted thereto prior to entering the internal cavity 16, thus providing the mixing effect as it moves to the individual channels 13 in a uniform fashion. Additionally, relatively small openings 24 provide uniform dispersement of both phases (liquid and vapor) of refrigerant along the cavity 16 of the manifold 11. It should be noted that the openings 24 may have various shapes and be of different sizes, preferably with the diminishing sizes as the refrigerant flows from the inlet 14 of the manifold 11 to the remote end of the spirally formed insert 21. Furthermore, a spirally formed insert 21 may itself have enhancement elements to further promote mixing process. For instance, the insert 21 can be manufactured from a twisted tube, have surface indentations, etc.

Figure 2B:
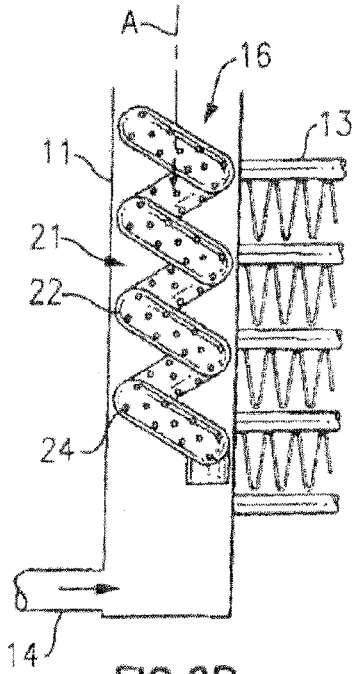
FIG. 2B is a variation of the FIG. 2A embodiment.

In FIG. 2B there is shown a variation of this design wherein, rather than the refrigerant being directed to flow only into the insert 21, the flow is directed to flow from the inlet 14 to the cavity 16 where it can flow into the insert 21 and over its outer surface, both of which will tend to impart a swirl to the flow. Of course, relevant hydraulic impedances have to be managed, by the insert dimensions, insert relative location inside the manifold and insert opening sizes, to ensure a proper refrigerant flow split into and over the insert 21.

Figure 2C:
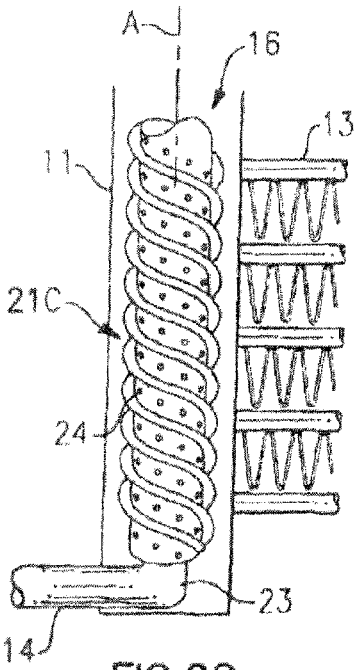
FIG. 2C is another variation of the FIG. 2A embodiment.

In the FIG. 2C embodiment the insert 21C is also designed to give a swirling motion to the fluid flow. However, rather than a coiled tube 21 as shown in FIG. 2A, the tube 21C is twisted as shown to provide a swirling motion to the fluid as it exists the openings 24 and enters the internal cavity 16.

Figure 2D:
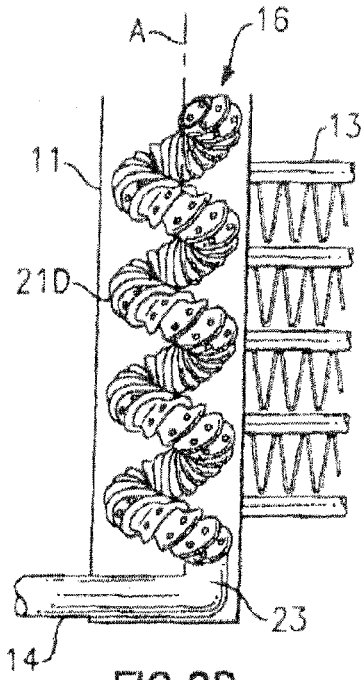
FIG. 2D is yet another variation of the FIG. 2A embodiment.

The FIG. 2D embodiment combines the features of the FIGS. 2A and 2C embodiments such that the tube 21D is both twisted and coiled.

Figure 3:
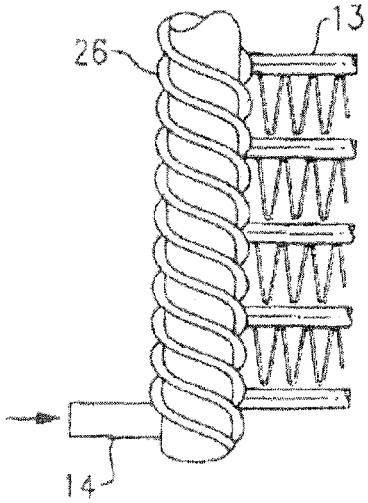
FIG. 3 is an alternative embodiment thereof.

In the FIG. 3 embodiment, the inlet header 11 of the previously described embodiment is replaced by an inlet header 26 that is, itself, formed in a spirally twisted tube. An inlet opening 14 is fluidly connected at one end of the inlet header 26 so as to introduce the flow of refrigerant thereto. As the refrigerant enters the inlet header 26, it flows through the internal cavities of the inlet header 26 to thereby have a swirling motion (typically at increased velocity and more homogeneous conditions) imparted thereto.

Fluidly connected to the inlet header 26, is the plurality of parallel channels 13 for receiving the refrigerant flow from the inlet header 26. Because of the swirling motion imparted to the flow of refrigerant within the inlet header 26, the refrigerant flowing to the individual microchannels 13 is uniformly distributed so as to obtain maximum efficiency from the heat exchanger. It should be noted that the inlet header 26 may be of a progressively diminishing size to reflect a reduction in the refrigerant mass flow rate toward a remote end of the inlet header 26. Once again, the inlet header 26 may have enhancement elements, such as surface indentations or internal fins, to further promote the mixing process.

Figure 4:
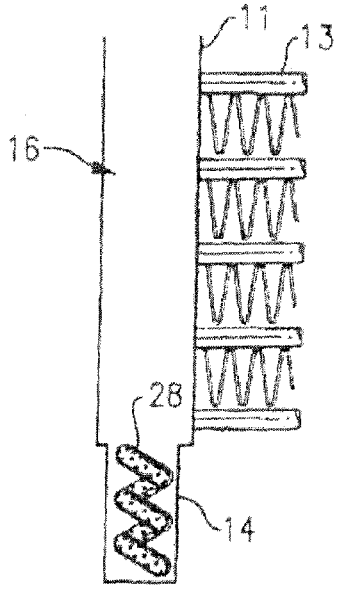
FIG. 4 is another alternative embodiment thereof.

Referring now to FIG. 4, an alternative embodiment is shown wherein an insert 28 is placed within the inlet opening 14 as shown rather than within the internal cavity 16 of the inlet manifold 11. The insert 21 is preferably suspended in a coaxial relationship with the inlet opening 14 by way of brazing or the like to the sides of the inlet opening 14. The insert 28 may be closed so as to allow the refrigerant to flow around the outer surfaces thereof so as to impart a swirling motion to the refrigerant entering the internal cavity 16 of the inlet manifold 11. Alternatively, the spiral insert 28 may be opened at its ends such that the refrigerant may pass through the internal confines thereof as it flows through the length of the insert 28 and enters the internal cavity 16. It may also be so constructed as to pass the refrigerant both through the internal structure and the outer surface of the insert 28 as it enters the internal cavity 16. In all cases, the swirling motion imparted to the refrigerant as it enters the internal cavity 16 provides a uniform, homogenous refrigerant mixture as it flows along the manifold 11 and enters the individual channels 13.

Figure 5A:
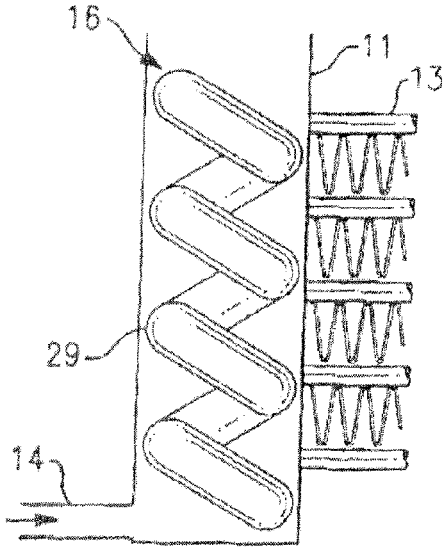
FIG. 5A is yet another alternative embodiment thereof.

Another embodiment of the present invention is shown in FIG. 5A wherein an insert 29 is preferably coaxially disposed within the internal cavity 16 of the inlet manifold 11, in a manner similar to that of the FIG. 2A embodiment. However, rather than the refrigerant being routed through the insert 29, it is designed to have the refrigerant pass over the spirally formed outer surface of the insert 29 similar to the manner in which this occurs in the FIG. 4 embodiment. Again, the insert 29 is mounted to the inlet manifold by brazing or the like to the sides or end of the inlet manifold 11. The swirling high velocity motion that is imparted by the flow of refrigerant over the outer surfaces of the insert again brings about the delivery of a uniform mixture of refrigerant to the individual channels 13.

Figure 5B:
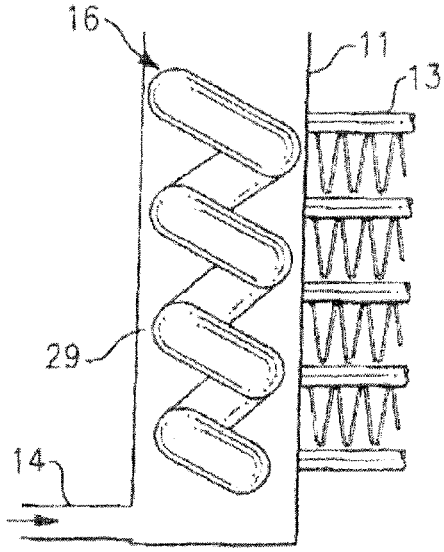
FIG. 5B is a variation of the FIG. 5A embodiment.

A variation of this design is shown in FIG. 5B wherein there is provided a variable diameter (and subsequently a cross-section area) of the insert 29 along its length. Preferably, the diameter of the insert 29 increases toward the downstream end of the inlet manifold 11 so as to reflect a reduction in the refrigerant mass flow rate and accordingly impede the flow to the downstream channels 13. Obviously, other geometric characteristics may be varied in a similar fashion to cause an identical overall effect on a hydraulic resistance change along the insert 29 axis.

In each of the embodiments of the present invention as shown in FIGS. 2-5, the swirling high velocity motion that is imparted to the refrigerant flow tends to solve the problem of maldistribution of refrigerant, create homogeneous conditions and bring uniform refrigerant mixture to the entrance of the individual channels. At high refrigerant flow velocities, the droplets of the liquid refrigerant phase are driven to the periphery of the manifold by the centrifugal force so as to allow some of them to enter the channels closest to the header entrance. In cases of low refrigerant flow velocities, the swirling motion creates a momentum and jetting effect that tend to carry some of the liquid droplets to the remote channels in the manifold. Additionally, the swirling motion promotes mixing of liquid and vapor phases of refrigerant creating a homogeneous substance. Thus, the swirling motion tends to overcome the previous problems of maldistribution of refrigerant to the individual channels.

It is well understood to a person ordinarily skilled in the art that any of the embodiments can be combined in a singled design if desired. Also, the teachings of the invention can benefit any heat exchanger orientation and configuration.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A heat exchanger of the type having longitudinally extending inlet and outlet manifolds fluidly interconnected by a plurality of parallel channels for conducting the flow of refrigerant therebetween, each channel of the plurality of parallel channels having an entrance, characterized in that said inlet manifold comprises a spirally twisted tube that progressively diminishes in size in the direction of refrigerant flow there through and extends along and is fluidly interconnected to the respective entrances to the plurality of parallel channels.

2. The heat exchanger as set forth in claim 1 wherein flow mixing enhancement elements are provided in an internal cavity of said spirally twisted tube.

3. A method of promoting uniform refrigerant flow from an inlet manifold of a heat exchanger to a plurality of parallel channels fluidly connected thereto, each channel of the plurality of parallel channels having an entrance, comprising the steps of:

forming said inlet manifold as a spirally twisted tube having an internal cavity and progressively diminishing in size in the direction of refrigerant flow there through, and extending along the respective entrances to the plurality of parallel channels;

fluidly interconnecting to the respective entrances to the plurality of parallel channels to the internal cavity; and introducing a flow of refrigerant into the internal cavity to flow through the internal cavity of the inlet manifold into each channel of the plurality of parallel channels.

4. The method as set forth in claim 3 further comprising the step of providing flow mixing enhancement elements in the internal cavity of said spirally twisted tube.

* * * * *